US006470723B2

(12) United States Patent
Sumitomo et al.

(10) Patent No.: US 6,470,723 B2
(45) Date of Patent: Oct. 29, 2002

(54) APPARATUS FOR MANUFACTURING INTERNAL GROOVED TUBE

(75) Inventors: Tetsuya Sumitomo; Koji Yamamoto; Toshiaki Hashizume, all of Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/873,932

(22) Filed: Jun. 4, 2001

(65) Prior Publication Data

US 2002/0104350 A1 Aug. 8, 2002

(51) Int. Cl.[7] ..... B21B 15/00
(52) U.S. Cl. ..... 72/75; 72/43; 72/283
(58) Field of Search ..... 72/43, 75, 77, 72/78, 112, 278, 282, 283

(56) References Cited

U.S. PATENT DOCUMENTS

| | | | | |
|---|---|---|---|---|
| 4,373,366 A | * | 2/1983 | Tatsumi | 72/75 |
| 4,712,407 A | * | 12/1987 | Yoshiki et al. | 72/68 |
| 4,876,869 A | * | 10/1989 | Saeki et al. | 72/68 |
| 5,526,663 A | * | 6/1996 | Sauvonnet et al. | 72/43 |

FOREIGN PATENT DOCUMENTS

| | | |
|---|---|---|
| JP | 55-103215 | 8/1980 |
| JP | 59-97724 | 6/1984 |
| JP | 59-163027 | 9/1984 |
| JP | 61-286018 | 12/1986 |
| JP | 62-39855 | 10/1987 |
| JP | 62-39856 | 10/1987 |
| JP | 63-62294 | 12/1988 |

* cited by examiner

*Primary Examiner*—Ed Tolan
(74) *Attorney, Agent, or Firm*—Knobbe Martens Olson & Bear LLP

(57) ABSTRACT

The present invention is an apparatus for manufacturing an internal grooved tube, in which has a rotary die and a working head having a plurality of balls retained inside in such a way as to rotate with play are provided along the drawing direction of a metal blank tube in order and in such a way as to rotate separately, which is constructed in such a way that multiple grooves are formed in the internal surface of the metal blank tube by pressing the metal blank tube where a plug and a grooved plug rotatably coupled to the plug are inserted against the outer surface of the grooved plug as the metal blank tube is put through the rotary die and the working head and drawn, and which has lubricating-oil feeding units and separatedly provided at upstream sides of the rotary die and the working head.

1 Claim, 3 Drawing Sheets

APPARATUS FOR MANUFACTURING INTERNAL GROOVED TUBE

BACKGROUND OF THE INVENTION

1. Field of the Invention

This invention relates to an apparatus for manufacturing an internal grooved tube (a heat exchanger tube) having multiple axial-directional or spiral parallel grooves formed in the internal surface.

2. Description of the Prior Art

Referring to FIG. 4, a conventional apparatus for manufacturing an internal grooved tube will be described.

A rotary die 2 having a cylindrical cover 21 and a working head 3 integrally coupled to the rotary die 2 are provided in order at the upstream side along the drawing direction of a metal blank tube 1*a*.

The working head 3 has a conical internal surface which becomes wider toward the downstream side in the drawing direction. Aligned inside the working head 3 are a plurality of balls 6 positioned at equal intervals around the metal blank tube 1*a* which turns in contact with the internal surface and passes inside the working head 3. Those balls 6 are pressed toward the upstream side in the drawing direction by a flange-shaped stopper 31 attached to another member through a bearing 32 at the downstream side.

A shaping die 7 is provided further downstream of the working head 3 in the drawing direction.

A lubricating-oil feeding unit 22 which feeds a lubricating oil to the outer surface of the metal blank tube 1*a* is provided downstream of the cover 21 in the drawing direction.

At the time the manufacturing apparatus is operated, as shown in FIG. 4, the metal blank tube 1*a* is put through the rotary die 2, the working head 3 and the shaping die 7, and a plug 4 and a grooved plug 5 rotatably coupled to the plug 4 through a plug rod 51 are inserted in the metal blank tube 1*a*. While the metal blank tube 1*a* is drawn rightward in the figure, the rotary die 2 and the working head 3 are rotated together by unillustrated same drive means. Multiple spiral grooves (projections) having a predetermined lead angle with respect to the axial direction are formed in parallel on the outer surface of the grooved plug 5.

Through the above-described operation of the apparatus, the diameter of the metal blank tube 1*a* is reduced by the rotary die 2 and the plug 4. Then, the metal blank tube 1*a* is pressed against the outer surface of the grooved plug 5 at the position of the grooved plug 5 by the plural balls 6 which rotates with play while revolving around the metal blank tube 1*a* in accordance with the rotation of the working head 3, and multiple fine grooves 10 are formed on the internal surface of the metal blank tube 1*a*, thus producing a tube 1 with a grooved internal surface. The internal grooved tube 1 is shaped while its diameter is reduced by the shaping die 7.

During the operation of the apparatus, the lubricating-oil feeding unit 22 supplies the lubricating oil to the outer surface of the metal blank tube 1*a*. The lubricating oil is supplied to a work portion in the rotary die 2 through the outer surface of the metal blank tube 1*a* that is moved in the drawing direction and is also supplied to a work portion in the working head 3 through a plurality of oil passages 23 formed toward the interior of the working head 3 from a position closer to the outer portion than a drawing hole of the rotary die 2.

The apparatus for manufacturing an internal grooved tube is designed in such a way that the rotary die 2, not a fixed die, which rotates in the aforementioned manner, is placed upstream in the drawing direction and the drawing resistance is decreased by changing the direction of friction between the metal blank tube 1*a* and the rotary die 2 at that portion (the direction of friction being inclined to the drawing direction), thereby reducing the drawing load applied to the metal blank tube 1*a*.

SUMMARY OF THE INVENTION

An apparatus for manufacturing an internal grooved tube according to the present invention comprises a rotary die, a plug inserted in a metal blank tube which is put through the rotary die and drawn therefrom and performs a diameter-reducing work on the metal blank tube together with the rotary die, a grooved plug which is rotatably coupled onto the axial line of the plug in the direction of the distal end thereof through a plug rod and has multiple axial-directional or spiral grooves formed in the outer surface, and a working head which is provided in such a way that the metal blank tube passes inside at the position of the grooved plug and rotates independently of the rotary die. A conical internal surface which becomes wider in the drawing direction of the metal blank, tube is formed inside the working head.

A plurality of balls are retained inside the working head in such a way as to rotate in contact with the outer surface of the metal blank tube and the conical internal surface and to be pressed against the outer surface of the grooved plug through the metal blank tube. The individual balls are constructed in such a way as to revolve on the same circular orbit about the metal blank tube as the working head rotates.

A first lubricating-oil feeding unit which feeds a lubricating oil to a work portion of the rotary die is provided upstream of the rotary die in the drawing direction of the metal blank tube. Further, a second lubricating-oil feeding unit which feeds a lubricating oil to the surface of the metal blank tube which passes inside the working head is provided downstream of the rotary die in the drawing direction and upstream of the working head in the drawing direction.

BRIEF DESCRIPTION OF THE DRAWINGS

The foregoing and other objects and features of the invention will become apparent from the following description of the embodiment of the invention with reference to the accompanying drawings, in which.

DETAILED DESCRIPTION OF THE EMBODIMENTS

Figure 1:
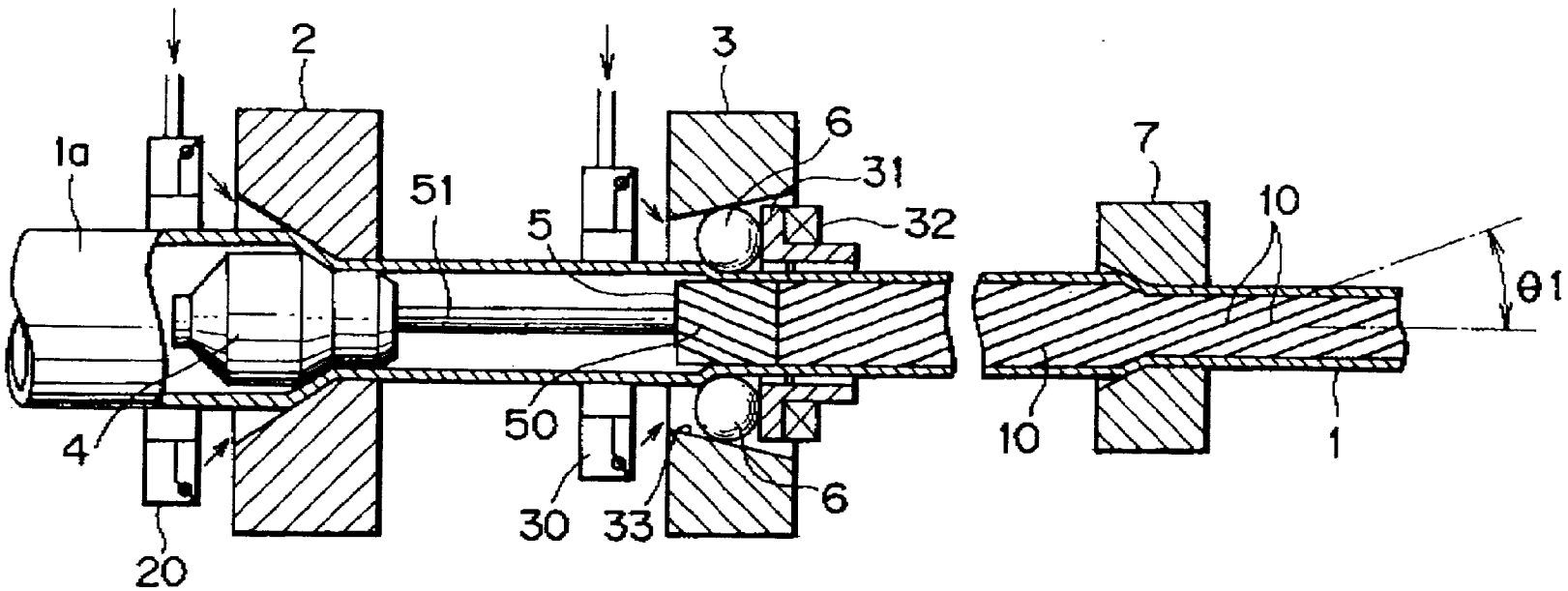
FIG. 1 is a cross-sectional view illustrating one embodiment of an apparatus for manufacturing an internal grooved tube according to the present invention.

As exemplified in FIG. 1, a rotary die 2 which rotates in a predetermined direction and a working head 3 independent of the rotary die 2 are provided in order in the drawing direction of a metal blank tube 1*a* in such a way as to be respectively rotated by unillustrated separate drive means. A shaping die 7 is provided downstream of the working head 3 in the drawing direction.

Prior to the operation of the manufacturing apparatus, the metal blank tube 1*a* is so set as to be put inside the rotary die 2, the working head 3 and the shaping die 7 in order.

Figure 2:
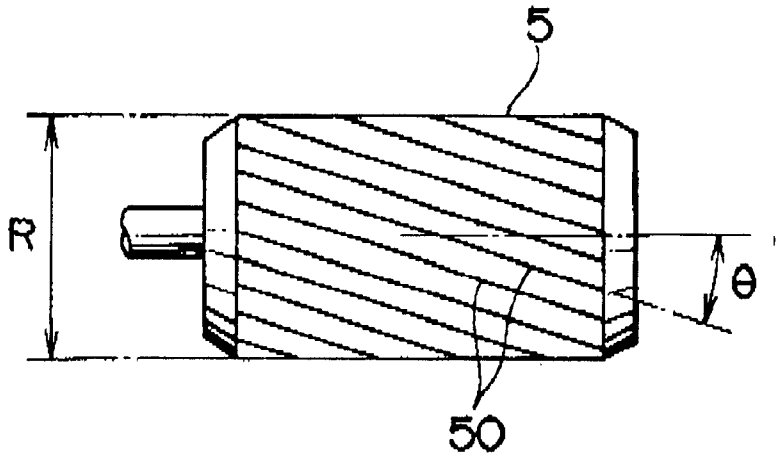
FIG. 2 is an enlarged front view of a grooved plug used in the manufacturing apparatus in FIG. 1.

A plug 4 which performs a diameter-reducing work on the metal blank tube 1*a* together with the rotary die 2 is inserted in the metal blank tube 1*a* set in the aforementioned manner. A grooved plug 5 is rotatably coupled onto the axial line of the plug 4 in the direction of the distal end thereof through a plug rod 51 in such a way as to be positioned at the center portion of the working head 3. As shown in FIGS. 1 and 2, multiple spiral grooves 50 are formed in parallel in the outer surface of the grooved plug 5.

A plurality of balls 6 are retained inside the working head 3 in such a way as to rotate in contact with the outer surface of the metal blank tube 1*a* which is being drawn and to be pressed against the outer surface of the grooved plug 5 through the metal blank tube 1*a*. The individual balls 6 revolve on the same circular orbit about the metal blank tube 1*a* as the working head 3 rotates.

A conical internal surface 33 which becomes wider toward the downstream side in the drawing direction is formed in the working head 3 according to the embodiment in such a way as not to interfere with the metal blank tube 1*a* which is being drawn. The plural balls 6 are inserted inside the working head 3 in such a way as to be positioned at equal intervals around the metal blank tube 1*a* which turns in contact with the internal surface 33 and passes inside the working head 3. Those balls 6 are pressed toward the upstream side in the drawing direction by a flange-shaped stopper 31 attached to another unillustrated member through a bearing 32 at the downstream side in the process of drawing the metal blank tube 1*a*.

A first lubricating-oil feeding unit 20 which feeds a lubricating oil to the Work portion of the rotary die 2 is provided upstream of the rotary die 2 in the drawing direction of the metal blank tube 1*a*, and a second lubricating-oil feeding unit 30 which feeds a lubricating oil to a work portion in the working head 3 is provided downstream of the rotary die 2 and upstream of the working head 3 in the drawing direction.

A metal tube of a material with a good thermal conductivity, such as preferably copper, its alloy, aluminum or its alloy, is selected for the metal blank tube 1*a*.

During the operation of the apparatus for manufacturing an internal grooved tube according to the embodiment, the rotary die 2 and the working head 3 are rotated in the same direction by the respective separate drive units while drawing the metal blank tube 1*a* rightward in the state in FIG. 1. During operation, the first and second lubricating-oil feeding units 20 and 30 supply lubricating oils to the respective work portions.

The diameter of the metal blank tube 1*a* is reduced between the rotary die 2 and the plug 4 in accordance with the drawing action. Next, the outer surface of the metal blank tube 1*a* is pressed against the surface of the grooved plug 5 at the position of the grooved plug 5 by the plural balls 6 that revolve around the blank tube 1*a* and rotate as the working head 3 rotates. As the grooves 50 in the outer surface of the grooved plug 5 are transferred to the internal surface of the metal blank tube 1*a* this way, the tube 1 with a grooved internal surface having multiple fine grooves 10 in the internal surface is manufactured continuously.

The internal grooved tube 1 is shaped later by the shaping die 7 located at the downstream side and its diameter is reduced at the same time.

According to the manufacturing apparatus of the embodiment, as multiple fine grooves 50 having a predetermined lead angle θ with respect to the axial center are formed in parallel in the outer surface of the grooved plug 5 as shown in FIG. 2, the grooves 10 having a predetermined lead angle θ1 corresponding to the grooves 50 (undulations) with respect to the tube axis are formed in the internal surface of the internal grooved tube 1 that is manufactured in the above-described manner.

Figure 4:
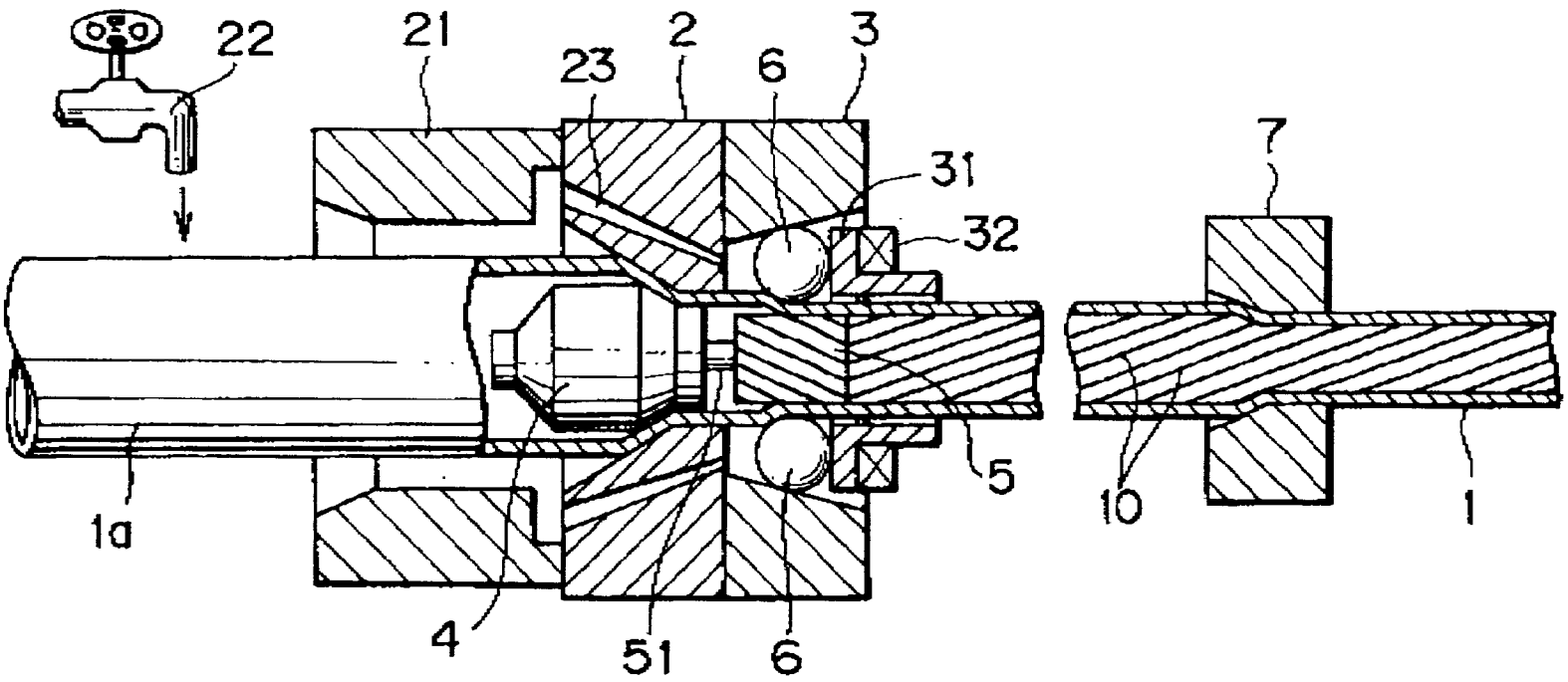
FIG. 4 PRIOR ART
FIG. 4 is a cross-sectional view illustrating an apparatus for manufacturing an internal grooved tube in the prior art.

According to the conventional apparatus for manufacturing an internal grooved tube as shown in FIG. 4, the rotary die 2 and the working head 3 are integrally coupled together and are rotated by common drive means, so that both always have the same number of rotations. When the number of rotations of the working head 3 is increased to speed up the working speed (given that the amount of drawing the metal blank tube per the number of rotations of the working head is constant, the drawing amount or the working speed increases in proportion to an increase in the number of rotations), the number of rotations of the rotary die 2 likewise increases and the working head at the work portion of the rotary die 2 significantly increases.

According to the manufacturing apparatus of the embodiment according to the present invention, by way of contrast, the rotary die 2 and the working head 3 are dependent of each other and are so designed as to be rotated by the respective separate drive means, so that the working head at the work portion of the working head 3 and the working heat at the work portion of the rotary die 2 do not increase or decrease in proportion. Therefore, it is possible to set the number of rotations of the rotary die 2 to the minimum required number of rotations for reducing the drawing load for the metal blank tube 1*a* and set the number of rotations of working head 3 to the number of rotations which provides a target working speed for working the grooves.

In the conventional manufacturing apparatus shown in FIG. 4, the lubricating oil to be supplied to the work portion in the working head 3 from the lubricating-oil feeding unit 22 reaches the work portion in the working head 3 through the plural oil passages 23 formed toward the interior of the working head 3 from the position closer to the outer portion than the drawing hole of the rotary die 2, increasing the number of rotations of the working head 3 (which increases the number of rotations of the rotary die) makes it hard for the lubricating oil to be drawn into the oil passages 23. Therefore, cooling of the working heat that has increased at the groove-working portion by an increase in the number of rotations of the working head 3 becomes insufficient, thus causing oxidation of the surface of the metal blank tube and burning of the tube surface.

According to the manufacturing apparatus of the embodiment according to the present invention, by way of contrast, separate lubricating-oil feeding units 20 and 30 respectively feed lubricating oils to the work portions of the rotary die 2 and the working head 3, and the amounts of the lubricating oils that match with the amounts of working heat are fed to the respective work portions, thereby sufficiently lubricating and cooling the work portions. This may prevent oxidation and burning of the tube surface.

Because of the above-described reasons, the apparatus for manufacturing an internal grooved tube according to the present invention may smoothly manufacture a high-performance internal grooved tube which has a sharper shape and deeper grooves without lowering the working speed.

In the apparatus for manufacturing an internal grooved tube according to the present invention, it is necessary and sufficient to construct the working head 3 in such a manner that the plural balls 6 are retained inside in such a way as to be pressed against the outer surface of the grooved plug 5 through the metal blank tube 1*a* while rotating in contact with the outer surface of the metal blank tube 1*a* and the individual balls 6 rotate while revolving on the same circular orbit about the metal blank tube 1*a* as the working head 3 rotates. Therefore, the structure where the conical internal surface 33 which becomes wider in the drawing direction is formed in the working head 3 and the internal surface 33 and the stopper 31 support the balls 6 is not essential to demonstrate the above-described effect.

Manufacturing Tests or Like

With data on the individual sections set as follows, heat exchanger tubes (internal grooved tubes) were manufactured using the illustrated manufacturing apparatus of the embodiment (example of present invention), a manufacturing apparatus (comparative example 1) having a fixed die replacing the rotary die 2 in the manufacturing apparatus in FIG. 1, and a manufacturing apparatus (comparative example 2) shown in FIG. 4.

The heat exchanger tubes were manufactured by changing the number of rotations of the rotary die, the number of rotations of the working head and the working speed in the present invention, changing the number of rotations of the working head and the working speed in the comparative example 1, and changing the number of rotations of the rotary die and the working head and the working speed in the comparative example 2 as shown in Table 1, and the shape of the grooves of the heat exchanger tubes and the qualities of the outer surfaces of the tubes were compared with one another.

The "groove shape" and "quality of tube outer surface" in Table 1 are shown by ○ and X according to the following standards.

Groove shape;

○=worked to the desired groove depth

X=not worked to the desired groove depth

Quality of Tube outer surface:

○=no oxidation coloring and burning

X=oxidation coloring and burning present

Data on individual sections

Blank tube: material=cooper tube, outside diameter of 10 mm, thickness=0.40 mm

Figure 3:
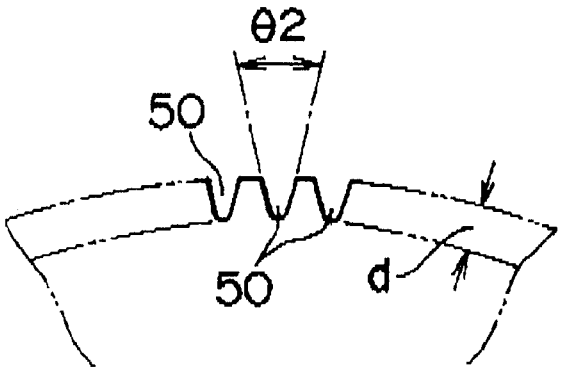
FIG. 3 is a partly enlarged cross-sectional view of the grooved plug.

Grooved plug: outside diameter R=8 mm, groove quality=50, lead angle θ=20° groove depth d=0.28 mm, groove bottom angle (FIG. 3) θ2=15°

Working balls: outside diameter=10 mm, laid quality=4 at intervals of 90°

Rotating direction of rotary die:

right ward rotation (clockwise in the drawing direction)

Rotating direction of working die:

same as the above

Rotating direction of grooved plug:

leftward rotation (lead angle of right angle)

TABLE 1

| Type | Rotary die number of rotations (rpm) | Working head number of rotations (rpm) | Working speed (m/min) | Groove shape | Quality of tube outer surface |
|---|---|---|---|---|---|
| Example of the invention | 2,000 | | | ○ | ○ |
| | 4,000 | 10,000 | 20 | ○ | ○ |
| | 6,000 | | | ○ | ○ |
| | 2,000 | | | X | ○ |
| | 4,000 | 20,000 | 40 | ○ | ○ |
| | 6,000 | | | ○ | ○ |
| | 2,000 | | | broken | — |
| | 4,000 | 30,000 | 60 | X | ○ |
| | 6,000 | | | ○ | ○ |
| Comparative example 1 | | 10,000 | 20 | ○ | ○ |
| | | 20,000 | 40 | broken | — |
| | | 30,000 | 60 | — | — |
| Comparative example 2 | 10,000 | | 20 | ○ | ○ |
| | 20,000 | | 40 | ○ | X |
| | 30,000 | | 60 | broken | — |

According to the manufacturing apparatus of the example of the present invention, a sufficient drawing reducing effect to achieve the working speed of 60 m/min was acquired and faster and excellent groove working was possible when the number of rotations of the rotary die 2 was increased to 6,000 rpm, as shown in Table 1.

According to the manufacturing apparatus of the comparative example 1 which used the fixed die, excellent groove working was possible until the number of rotations of the working head become 10,000 rpm and the working speed become 20 m/min. However, when the number of rotations of the working head and the working speed exceeded the mentioned values, the drawing load applied to the metal blank tube during groove working increased and the tube was broken.

According to the manufacturing apparatus of the comparative example 2 in which the rotary die and the working head are rotated together, excellent groove working was possible until the number of rotations of the working head=20,000 rpm and the working speed=40 m/min. However, when the number of rotations of the rotary die and the working head and the working speed exceeded the mentioned values, the working heat increased significantly, causing oxidation coloring of the tube surface, and the tube was broken due to the insufficient lubricating oils at the work portions.

As the apparatus for manufacturing an internal grooved tube according to the present invention may smoothly manufacture a high-performance internal grooved tube having a shaper cross-sectional shape and deeper grooves in the internal surface without lowering the working speed, it is advantageous in efficiently manufacturing a seamless heat exchanger tube to be used in an heat exchanger.

What is claimed is:

1. An apparatus for manufacturing an internal grooved tube comprising:

a rotary die which rotates in a predetermined direction;

a plug inserted in a metal blank tube which is put through said rotary die and drawn therefrom and performs a diameter-reducing work on said metal blank tube together with said rotary die;

a grooved plug rotatably coupled onto an axial line of said plug in a direction of a distal end thereof through a plug rod and having multiple axial-directional or spiral grooves formed in an outer surface;

a working head which is provided in such a way that said metal blank tube passes inside at a position of said grooved plug, has a conical internal surface formed inside that becomes wider in a drawing direction of said metal blank tube, and rotates independently of said rotary die;

a plurality of balls which are retained inside said working head in such a way as to rotate in contact with an outer surface of said metal blank tube and said conical internal surface to be pressed against said outer surface of said grooved plug through said metal blank tube, and revolve on the same circular orbit about said metal blank tube as said working head rotates;

a first lubricating-oil feeding unit for feeding a lubricating oil to a work portion of said rotary die from an upstream side in said drawing direction of said metal blank tube; and a second lubricating-oil feeding unit for feeding a lubricating oil to a work portion of said working head from an upstream side in said drawing direction of said metal blank tube.

* * * * *